United States Patent [19]

Malo

[11] 4,193,480

[45] Mar. 18, 1980

[54] RAILWAY CAR BRAKE RIGGING

[75] Inventor: Lowell L. Malo, St. Peters, Mo.

[73] Assignee: ACF Industries, Incorporated, New York, N.Y.

[21] Appl. No.: 920,311

[22] Filed: Jun. 28, 1978

[51] Int. Cl.[2] ..... B61H 13/04

[52] U.S. Cl. ..... 188/52; 74/110

[58] Field of Search ..... 188/33, 46, 47, 52, 188/53, 54, 55, 107, 153 R, 153 A; 74/109, 110

[56] References Cited

U.S. PATENT DOCUMENTS

| | | | |
|---|---|---|---|
| 50,051 | 9/1865 | Todd et al. | 188/33 |
| 210,935 | 12/1878 | Green | 74/109 |
| 507,469 | 10/1893 | Wilson et al. | 188/53 |
| 972,899 | 10/1910 | Morrison et al. | 188/53 |
| 1,762,586 | 6/1930 | Priebe | 188/52 |
| 2,065,200 | 12/1936 | Shafer | 188/52 |

FOREIGN PATENT DOCUMENTS

| | | | |
|---|---|---|---|
| 183 | of 1885 | United Kingdom | 188/53 |

*Primary Examiner*—Edward R. Kazenske
*Attorney, Agent, or Firm*—Henry W. Cummings

[57] ABSTRACT

In accordance with the present invention a brake rigging for applying the brakes to the wheels in a railway car includes a top rod extending over the inner axle which engages a gear located between the inner axle and the truck bolster. The gear includes a first inclined, vertically extending gear lever having a curved segment end portion having gear teeth which engage gear teeth on a curved segment portion of a second inclined, vertically extending gear lever which is connected to a brake beam extending between the inner wheels. In addition a bottom connection is connected to at least one of the first and second gear levers and extends through the truck bolster. The opposite end of the bottom connection is attached to an outer vertically extending lever, the lower end of which is attached to an outer brake beam for applying the brakes to the outer wheels.

9 Claims, 5 Drawing Figures

RAILWAY CAR BRAKE RIGGING

BACKGROUND OF THE INVENTION

This invention relates to brake rigging for railway cars. Previously, to apply the brakes to rail wheels located at the ends of the car, a longitudinally extending top rod is attached to a first vertical lever which is attached to an inner brake beam for applying the brakes to the inner wheels. A bottom connection is passed under the truck bolster to apply brake forces to the outer truck wheels. However, if this bottom connection becomes disconnected from its brake beam, the bottom connection can drop between the tracks and can cause the car to derail.

It has also been proposed to pass a top rod between the truck bolster and the car body, and a bottom rod back through the bolster to apply the brakes to the inner wheels. However this arrangement often results in interference between the top rod and the car body and/or truck bolster, particularly where long travel truck springs (above about two and one-half to three inches) are utilized. Furthermore if it is desired to provide the truck with an anti-hunting device, even greater clearance problems result when attempting to pass the top rod between the truck bolster and the car body.

In U.S. Pat. No. 3,184,000 a brake rigging is disclosed in which a brake rod is passed below the inner truck axle to the inner brake beam, and then a bottom connection is passed through an opening in the truck bolster to the outer brake beam. A dead lever rod extends below the outer axle and is attached to the car body. However this brake rigging utilizes relatively shorter levers (below one foot) and therefore the levers must pass through large angles (above about 60 degrees) when the brakes are applied.

SUMMARY OF THE INVENTION

In accordance with the present invention a brake rigging for applying the brakes to the wheels in a railway car includes a top rod extending over the inner axle which engages a gear located between the inner axle and the truck bolster. The gear includes a first inclined vertically extending gear lever having a curved segment end portion having gear teeth which engage gear teeth on a curved segment portion of a second inclined, vertically extending gear lever which is connected to an inner brake beam extending between the inner wheels. A bottom connection attached to at least one of the first and second gear levers with an appropriate fastening arrangement extends through the truck bolster, to an outer vertically extending lever. One end of the outer vertically extending lever is attached to an outer brake beams for applying the brakes to the outer wheels. When the top rod is pulled inwardly by the brake rigging including the brake cylinder, the first and second gear levers are moved inwardly, which moves the inner brake beam into engagement with the inner wheels. The second gear lever is then bottomed out on the inner brake beam. Further pulling by the top rod results in rotation of the engaged gear teeth and movement of the bottom connection outwardly through the bolster to apply the brakes to the outer wheels. The outer, vertically extending lever is preferably fulcrumed to the truck bolster.

THE DRAWINGS

DESCRIPTION OF PREFERRED EMBODIMENTS

Figure 1:
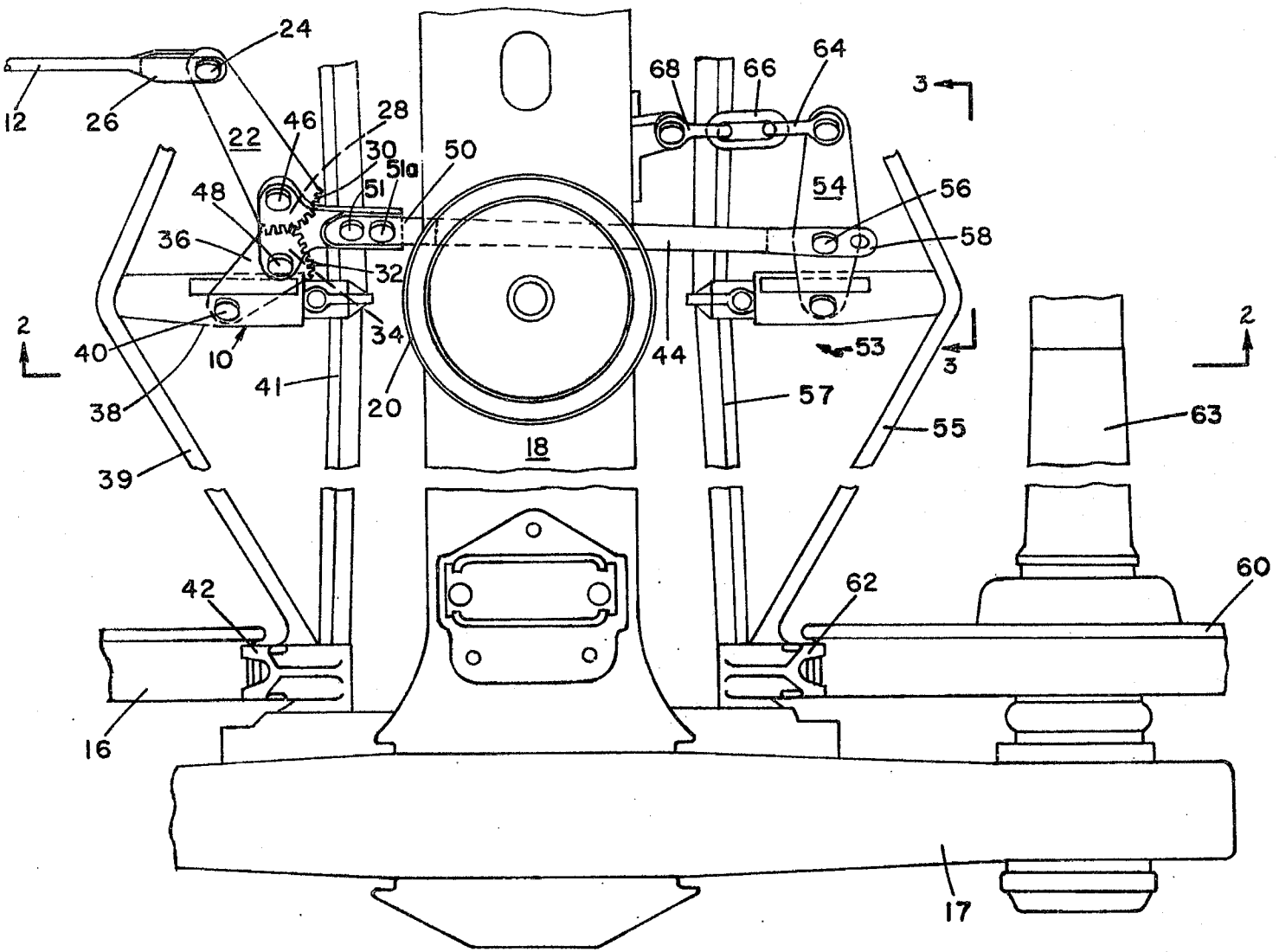
FIG. 1 is a plan view illustrating one embodiment of the brake rigging of the present invention.

The brake rigging of the present invention is indicated in the drawings generally at 10. The brake rigging includes a top rod 12 extending outwardly from a brake cylinder located inwardly of the car (not shown) which operates in the conventional manner. The top rod 12 passes over the inner wheel axle 14 (FIG. 2) which extends transversely between railway wheels 16 located inboard of side frames 17. Outwardly of the axle 14, but inwardly of the truck bolster 18 and center plate bowl 20, top rod 12 is attached to a first inclined, vertically extending gear lever 22 by means of a pin 24 passing through lever 22 and through top rod yoke 26. The opposite end of gear lever 22 is provided with a curved segment 28 having gear teeth 30 formed at the outer edges thereof. Gear teeth 30 engage gear teeth 32 formed in a curved segment 34 of a second vertically extending inclined gear lever 36. At its lower end gear lever 36 is connected to a transversely extending brake beam 38 by means of a pin 40. Brake beam 38 includes transversely extending legs 39 and 41, and brake shoes 42 of conventional construction for engagement with inner wheels 16 to slow or stop them.

Figures 3, 4, 5:
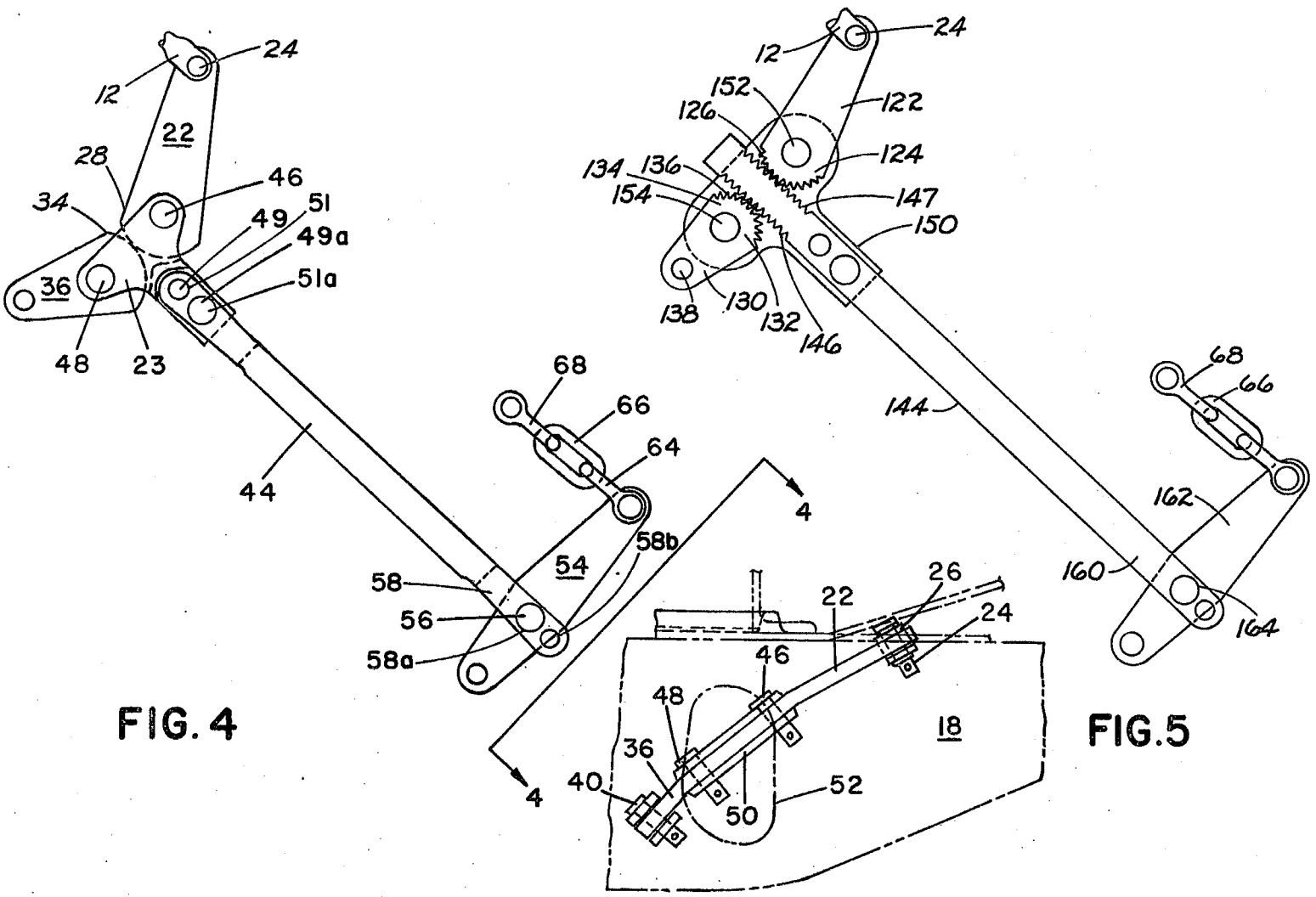
FIG. 3 is a transverse end view looking in the direction of the arrows along the line 3—3 in FIG. 1.
FIG. 4 is a projected view looking in the direction of the arrows along the line 4—4 in FIG. 3.
FIG. 5 is a projected view similar to FIG. 4 illustrating another embodiment of the present invention.

Levers 22 and 36 are each attached to a connecting yoke 23 with pins 46 and 48. Yoke 23 includes an extension 37, which extends within a yoke 50 located on the inner end of a longitudinally extending bottom connection 44. Extension 37 includes an opening **37*a*. Yoke 50 includes a pair of openings 49 and 49*a* (FIG. 4). Pins 51 and 51*a* extend through the openings 49, 49*a* and through opening 37*a* in yoke extension 37. Two openings and two pins are used to hold the parts rigid when in compression As an alternative, the yoke 50 and bottom connection 44** may be combined and formed as a single member, such as a forging.

Bottom connection 44 passes through an opening 52 in truck bolster 18. Bottom connection 44 includes a yoke 58 at its outer end. Yoke 58 is connected to an outer vertically extending lever 54 by means of a pin 56 passing through one of the openings **58*a* and 58*b* in yoke 58. Lever 54 is connected to brake beam 53 to apply brake forces through brake beam legs 55 and 57 to the outer wheels 60 by means of brake shoes 62. An axle 63 extends between wheels 60. Openings 58*a* are used with new brakes shoes 62 and openings 58*b* with worn shoes. A fulcrum clevis 64 attached to vertical lever 54 includes a linkage 66 and a clevis 68 connected to the truck bolster 18**. The fulcrum linkage can be altered as design changes dictate.

Figure 2:
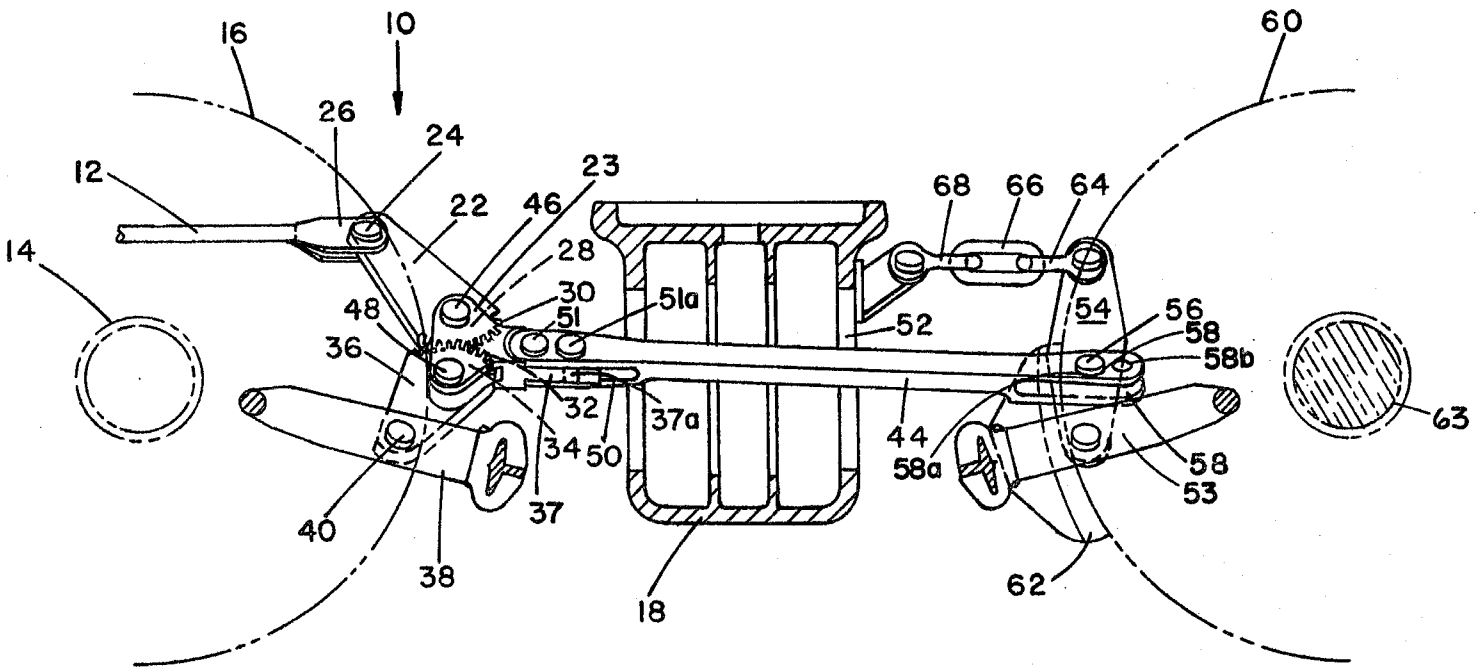
FIG. 2 is a vertical sectional view looking in the direction of the arrows along the line 2—2 in FIG. 1.

In the operation of the brake rigging of the present invention, when the top rod 12 is pulled inwardly of the car by means of the brake rigging including a brake cylinder (not shown) the top rod 12 moves from right to left in FIGS. 1 and 2. This in turn moves gear levers 22 and 36 from right to left and brake beam 38 from right to left. When brake shoes 42 engage wheels 16, right to left movement of levers 22 and 36 ceases. Lever 36 is bottom out on brake beam 38. However gear lever segment 28 rotates counterclockwise and gear lever segment 34 rotates clockwise. Some rotation of segments 28 and 34 may occur prior to the time that brake shoes 42 engage inner wheels 16. Rotation of segments 28 and 34 forces yoke 23 and bottom connection 44 outwardly through bolster opening 52 and moves lever 54 and brake beam 53 to the right until such time as the brake shoes 62 of brake beam 53 engage wheels 60 to slow or cease rotation of outer wheels 60.

When the brake cylinder is deactivated, top rod 12 moves from left to right. Gear segment 28 rotates in the clockwise direction and gear segment 34 rotates in the counterclockwise direction, drawing bottom connection 44 and lever 54 from right to left as break beam 53 moves from right to left, and brake shoes 62 moves out of engagement with front wheels 60. Further rotation of the gear segment 34 counterclockwise results in disengagement of brake shoes 42 on brake beam 38 with wheel 16, and left to right movement of brake beam 38, and levers 22 and 36 until neutral position shown in FIG. 2 is obtained.

It will be apparent that this brake rigging has the following advantages. The bottom connection 44 is held captive by the bolster 18. Therefore if the truck lever becomes disconnected from brake beams 53 or 38 it will not drag on the track, causing the possibility of derailment. The clearance problem of the top rod passing between the truck bolster and the car body is eliminated.

The diameter of gear segements 28 and 34 (FIG. 1) may be varied as desired to maintain brake application of lever 22 at a desired angle. If, for example, the diameter of curved segment 28 were larger than the diameter of curved segment 34, a small angular rotation of lever 22 would cause a larger angular rotation of lever 36.

Another embodiment of the invention is shown in FIG. 5. This embodiment is similar to the embodiment shown in FIGS. 1–4 and is oriented relative to the truck in the same manner. However, the top rod 12 is attached to a first vertical gear lever 122 having a curved segment portion 124 including pinion teeth 126. Located below gear lever 122 is another gear lever 132 having a curved segment portion 134 including pinion teeth 136.

Gear lever 130 is attached to a transversely extending brake beam 40 by means of a pin 138. A bottom connection 144 is similar to bottom connection 44 in FIGS. 1–4 except that at its inner end it includes a rack portion 146 having teeth 147. A yoke 150 is connected to pinion segments 124 and 132 with respective pins 152 and 154.

The opposite end 160 of bottom connection 144 is attached to a vertically extending gear lever 162 similar to lever 54 with a pin 164. Lever 162 applies the brakes to the front wheels in the same manner as lever 54.

The operation is similar to FIGS. 1–4. When top rod 12 moves from right to left in FIG. 5, lever 122 moves from right to left. Since yoke 150, lever 122 and lower lever 130 are connected by pins 152 and 154, these members also move from right to left until brake shoes 42 engage wheels 16 as described above and shown in FIG. 1. Lower gear lever 130 then bottoms out on brake beam 38. Further right to left movement of top rod 12 causes gear segments 124 and 134 to rotate. Pinion teeth 126 and 136 engage rack teeth 147 and move lever 144 from left to right to apply the outer brakes through lever 162. Movement of the top rod in the opposite direction (right to left in FIG. 5) first causes gear segments 124 and 134 to rotate in the opposite direction, moving lever 144 from right to left to release the outer brakes. Further right to left movement of top rod 12 causes gear levers 122 and 130 to move from left to right, to release the inner brakes, as rod 144 is moved further to the right.

What is claimed is:

1. A brake rigging for a railway car comprising: a top rod extending over an inner truck axle; said inner axle attached at opposite ends thereof to inner wheels; said top rod connected to a gear means located between said inner axle and a truck bolster; said gear means including a first gear lever having a curved segment end portion with gear teeth thereon which engage gear teeth on a curved segment portion of a second gear lever; said first and second gear levers lying in a common plane which is obliquely oriented relative to said inner axle; said second gear lever connected to an inner brake beam having shoes thereon and said inner brake beam extending between said inner wheels; inner connecting means attached to at least one of said first and second gear levers and connected to a first end of a longitudinally extending bottom connection which extends through said truck bolster; said bottom connection having an opposite end with outer connecting means for attaching said bottom connection to an outer brake means having shoes thereon for applying the brakes to a pair of outer wheels; whereby when said top rod is moved longitudinally of the car, said first and second gear levers are moved toward said inner axle, which moves said inner brake beam shoes into engagement with said inner wheels and prevented further inward movement of said second gear lever; and whereby further inward movement of the top rod results in relative rotation between said first and second gear levers and movement of said bottom connection outwardly through the bolster to move said outer brake beam outwardly to apply the outer brake shoes to said outer wheels.

2. A brake rigging according to claim 1 wherein the outer connecting means comprises an outer vertically extending lever.

3. A braking rigging according to claim 2 wherein said outer vertically extending lever is fulcrumed to the truck bolster through a longitudinally extending fulcrum linkage.

4. A brake rigging according to claim 2 wherein said bottom connection includes a yoke at its opposite end which is attached to said outer vertically extending lever.

5. A brake rigging according to claim 1 wherein said bottom connection includes a bottom connection yoke at its inner end and wherein said inner connecting means comprises a connecting yoke extending within said bottom connection yoke and attached to said first and second gear levers.

6. A brake rigging according to claim 1 wherein at least one of said first and second gear levers is inclined in the transverse direction.

7. A braking rigging according to claim 6 wherein both of said first and second gear levers are inclined in the transverse direction.

8. A brake rigging for a railway car comprising: a top rod extending over an inner truck axle; said inner axle attached at opposite ends thereof to inner wheels; said top rod connected to a gear means located between said inner axle and a truck bolster; said gear means including a first gear lever having a curved segment end portion with gear teeth thereon which engage an upper surface of a toothed rack and a second gear lever having a curved segment end portion with gear teeth thereon which engage a lower surface of said toothed rack; said first and second gear levers lying in a common plane which is obliquely oriented relative to said inner axle; said second gear lever connected to an inner brake beam having shoes thereon and said inner brake beam extending between said inner wheels; said toothed rack being integral with a longitudinally extending bottom connection which extends throgh the truck bolster; said bottom connection having an opposite end with outer connecting means for attaching said bottom connection to an outer brake beam having shoes thereon for applying the brakes to a pair of outer wheels; whereby when said top rod is moved longitudinally of the car, said first and second gear levers are moved toward said inner axle, which moves said inner brake beam shoes into engagement with the inner wheels and prevents further inward movement of said second gear lever; and whereby further inward movement of the top rod results in relative rotation between said first and second gears levers and said rack and movement of said bottom connecting outwardly through the bolster to move said outer brake beam outwardly to apply the outer brake shoes to said outer wheels.

9. A brake rigging according to claim 8 wherein the outer connecting means comprises an outer vertically extending lever.

* * * * *